US007401491B2

(12) United States Patent
Leland

(10) Patent No.: US 7,401,491 B2
(45) Date of Patent: Jul. 22, 2008

(54) BRAKE DIE INSERTS

(76) Inventor: David Leland, 10722 Highway 421 North, Milton, KY (US) 40045

( * ) Notice: Subject to any disclaimer, the term of this patent is extended or adjusted under 35 U.S.C. 154(b) by 124 days.

(21) Appl. No.: 11/222,705

(22) Filed: Sep. 9, 2005

(65) Prior Publication Data

US 2007/0056347 A1 Mar. 15, 2007

(51) Int. Cl.
*B21D 5/02* (2006.01)
*B21D 37/04* (2006.01)

(52) U.S. Cl. ..... 72/413; 72/389.3; 72/389.6; 72/481.1; 72/482.5

(58) Field of Classification Search ..... 72/389.1, 72/389.3, 389.6, 413, 414, 481.1, 482.5, 72/483.93
See application file for complete search history.

(56) References Cited

U.S. PATENT DOCUMENTS

| | | | | |
|---|---|---|---|---|
| 271,178 | A | 1/1883 | Wieser | |
| 553,156 | A * | 1/1896 | Facer | 72/482.5 |
| 2,966,934 | A | 1/1961 | Huet | |
| 3,075,416 | A * | 1/1963 | Stuhldreher | 72/463 |
| 3,276,236 | A | 10/1966 | McDowell | |
| 3,323,348 | A | 6/1967 | Pearson | |
| 3,474,657 | A | 10/1969 | Spiegel | |
| 3,914,972 | A | 10/1975 | Gillette et al. | |
| 5,125,252 | A | 6/1992 | Ayres et al. | |
| 5,146,774 | A | 9/1992 | Smith | |
| 5,211,045 | A | 5/1993 | Shimizu | |
| 5,249,452 | A * | 10/1993 | Baldwin et al. | 72/389.4 |

(Continued)

FOREIGN PATENT DOCUMENTS

EP 1 199 113 A1 4/2002

OTHER PUBLICATIONS

Power Brake Dies Inc.,"General Purpose and Special Press Brake Tooling", 1974, Catalog 480, pp. 1-17.*

*Primary Examiner*—David B Jones
(74) *Attorney, Agent, or Firm*—Ice Miller LLP

(57) ABSTRACT

A tool system for brake forming having a punch or a die and at least one insert. In one embodiment, two inserts are removably attached to a die. The die has a defined shape running along a longitudinal axis. Each insert has a protrusion with a particular cross-sectional shape running along the same longitudinal axis. The die has two cavities, each cavity having a cross-sectional shape matching the cross-sectional shape of the protrusion of one of the inserts. In another embodiment, the die has two protrusions and each insert has a cavity for receipt of one of the protrusions of the die. When one of the protrusions is inserted into one of the cavities, the insert is removably fixed to the die. At least one surface of each insert corresponds to and combines with the defined shape of the die, forming a bending surface against which a sheet of metal is formed. After press braking, the sheet of metal is substantially conformed to the defined shape of the die. In another embodiment, an insert is removably attached to a punch such that the insert forms the entire surface of the punch system that contacts the sheet of metal to be shaped during press braking. The inserts are positioned such that they encounter most of the wear caused by the brake forming, whereas the punch and the die encounter only minimal wear. As a result, the inserts are inexpensively repaired or replaced when needed, but the punch and the die remain in good condition during extended use.

24 Claims, 9 Drawing Sheets

U.S. PATENT DOCUMENTS 5,253,502 A * 10/1993 Poletti ..... 72/213
5,365,767 A 11/1994 Kitchen et al.
5,878,619 A * 3/1999 Walczak ..... 72/478
6,065,324 A * 5/2000 Russell ..... 72/387
6,171,359 B1 * 1/2001 Levinski et al. ..... 75/252
6,266,992 B1 7/2001 Butcher et al.
6,363,767 B1 4/2002 Papazian et al.
6,644,091 B2 * 11/2003 Huang et al. ..... 72/482.93
6,874,346 B1 * 4/2005 Faymonville ..... 72/389.4

* cited by examiner

BRAKE DIE INSERTS

BACKGROUND OF THE INVENTION

This invention relates to the field of mechanical metal deformation processes, and more particularly to brake forming.

The process of brake forming involves placement of a piece of sheet metal along a die and pressing a punch downward onto the die to form the sheet metal along a straight axis in a desired shape. Many shapes can result, but common shapes include a v-shape, channel-shape, and u-shape.

Press brake punches and dies are well known in the art, as are methods of making them. Because punches and dies repeatedly undergo significant forces during brake forming, they are generally made of hardened steel. Such steel must have sufficient hardness to provide the necessary strength and rigidity to maintain the effectiveness and shape of the punch and die over multiple uses.

A major problem with press brake tools is that they wear out quickly. After a certain number of uses, abrasion and galling cause deformation of the punch and the die. Because precision in brake forming is often critical, when the punch or the die begins to lose its shape, the press operator must make adjustments to the forming process, replace the punch or die, or repair the punch or die. Replacement and repair of punches and dies contribute to the costs of the brake forming process, as does having to shut the press down during the re-tooling.

It is therefore desired to develop a punch and a die that better resist wear from repeated use, but that do not significantly increase the costs of manufacture or decrease the performance of the press brake. In the past, dies have been created with inserts to decrease friction. For example, the invention of U.S. Pat. No. 3,914,972 includes a die having rotatable inserts made from an anti-friction material, such as TEFLON. However, being made from anti-friction material, these inserts cost more to produce, and must be replaced more often, than inserts made of harder, less expensive materials, such as steel. Further, because of the reduced hardness of such inserts, dies having these inserts may not be useable with some types of hardened sheet metal.

In addition, press brakes have been created in the past that include a removable punch insert and a removable die portion. For example, the invention of U.S. Pat. No. 5,878,619 includes such a system. However, these types of tool systems do not sufficiently reduce the expense of press braking. First, the removable punch insert does not comprise the entire bending surface of the punch, and therefore the punch itself undergoes wear from the press braking process and must be periodically repaired or replaced. In addition, the removable punch insert can be expensive to make because it is an intricate part that contains several different bending surfaces of different radii, each of which must be separately tooled to precise measurements. Second, the removable die portion does not sufficiently reduce expenses because it itself is the tool used to shape the metal, and is therefore susceptible to substantial wear. The removable die portion is expensive to repair or replace because it consists of the entire portion of the bending surface of the die and thus must be machined to the desired shape and radius.

SUMMARY

The present invention comprises a tool system for use in press braking and other types of mechanical metal deformation processes. In one embodiment, the tool system of the present invention comprises a die and two inserts. The die has a longitudinal axis and a defined shape along that axis. The die also has two cavities running along the longitudinal axis; each cavity has a cross-sectional shape.

Each insert has a longitudinal axis that corresponds to the longitudinal axis of the die. Additionally, each insert has a protrusion running along the longitudinal axis that has a cross-sectional shape. The cross-sectional shape of the protrusion of each insert matches the cross-sectional shape of at least one of the cavities of the die. These protrusions are inserted into the cavities in the die, causing a removably fixed mechanical interlock between each protrusion and each cavity. The interlock between each protrusion and each cavity is such that each insert is removably attached to the die. Therefore, after insertion, each insert is fixed onto the die, permitting little or no movement of the insert with respect to the die.

During operation of the press brake, the two inserts are removably attached to the die. At least one surface of each insert corresponds to and combines with the defined shape of the die to form the bending surface for shaping a sheet of metal. The sheet of metal is pressed against the bending surface by a press brake punch and consequently is conformed substantially to the shape of the bending surface. The defined shape of the die, and therefore the bending surface, may be substantially v-shaped, substantially u-shaped, or substantially channel-shaped. Alternatively, one of various other suitable shapes may be used.

In another embodiment of the present invention, the tool system comprises a die and two inserts, but the die has two protrusions running along the longitudinal axis of the die, with each protrusion having a cross-sectional shape. Each insert has a cavity running along the longitudinal axis of the die. The cavity of each insert has a cross-sectional shape that matches the cross-sectional shape of one of the protrusions of the die such that one protrusion of the die may be inserted into the cavity of each insert. As a result, each protrusion of the die and the cavity of each insert forms a removably fixed mechanical interlock. The two inserts are therefore removably attached to the die such that there is little or no movement of the inserts with respect to the die during operation of the press brake.

In another embodiment of the present invention, the tool system comprises a punch and an insert. The punch has a cavity running along the longitudinal axis of the punch, with the cavity having a cross-sectional shape. The insert has a protrusion along the same longitudinal axis. The protrusion has a cross-sectional shape that matches the cross-sectional shape of the cavity such that the protrusion of the insert may be inserted into the cavity of the punch to form a removably fixed mechanical interlock. The insert is therefore removably attached to the punch such that there is little or no movement of the insert with respect to the punch during operation of the press brake. In a further embodiment, the punch has a protrusion with a cross-sectional shape, and the insert has a cavity with a matching cross-sectional shape to form the removably fixed mechanical interlock.

Because the inserts are positioned such that they, rather than the punch or the die, undergo most of the wear during operation, wear on the punch or the die will be minimal. The punch or the die will need to be repaired or replaced only infrequently, thereby significantly lowering the costs of the press brake process. Replacing the inserts is a relatively quick, convenient, and inexpensive process that generally will restore the performance of the tool system to that of its first use.

DETAILED DESCRIPTION

Figure 1:
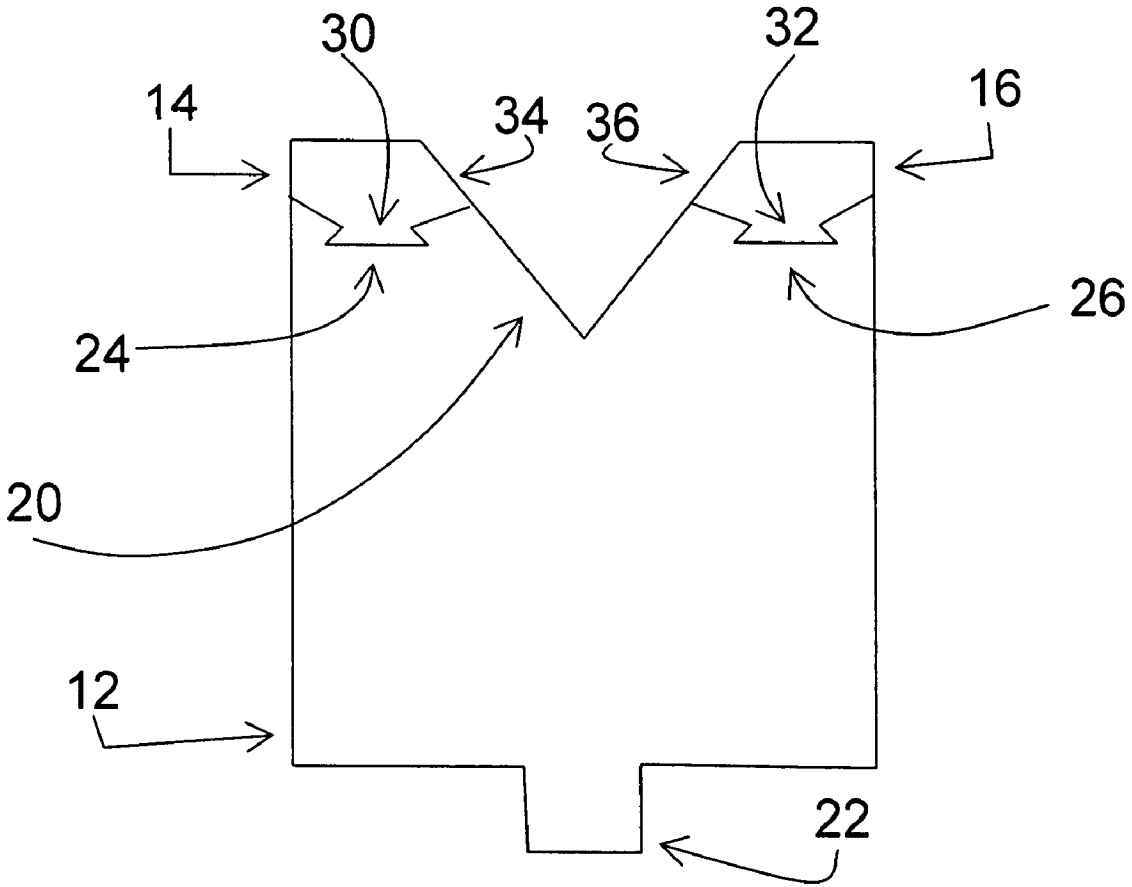
FIG. 1 shows a cross-sectional view of an embodiment of the present invention having a die and two inserts.
Figure 2:
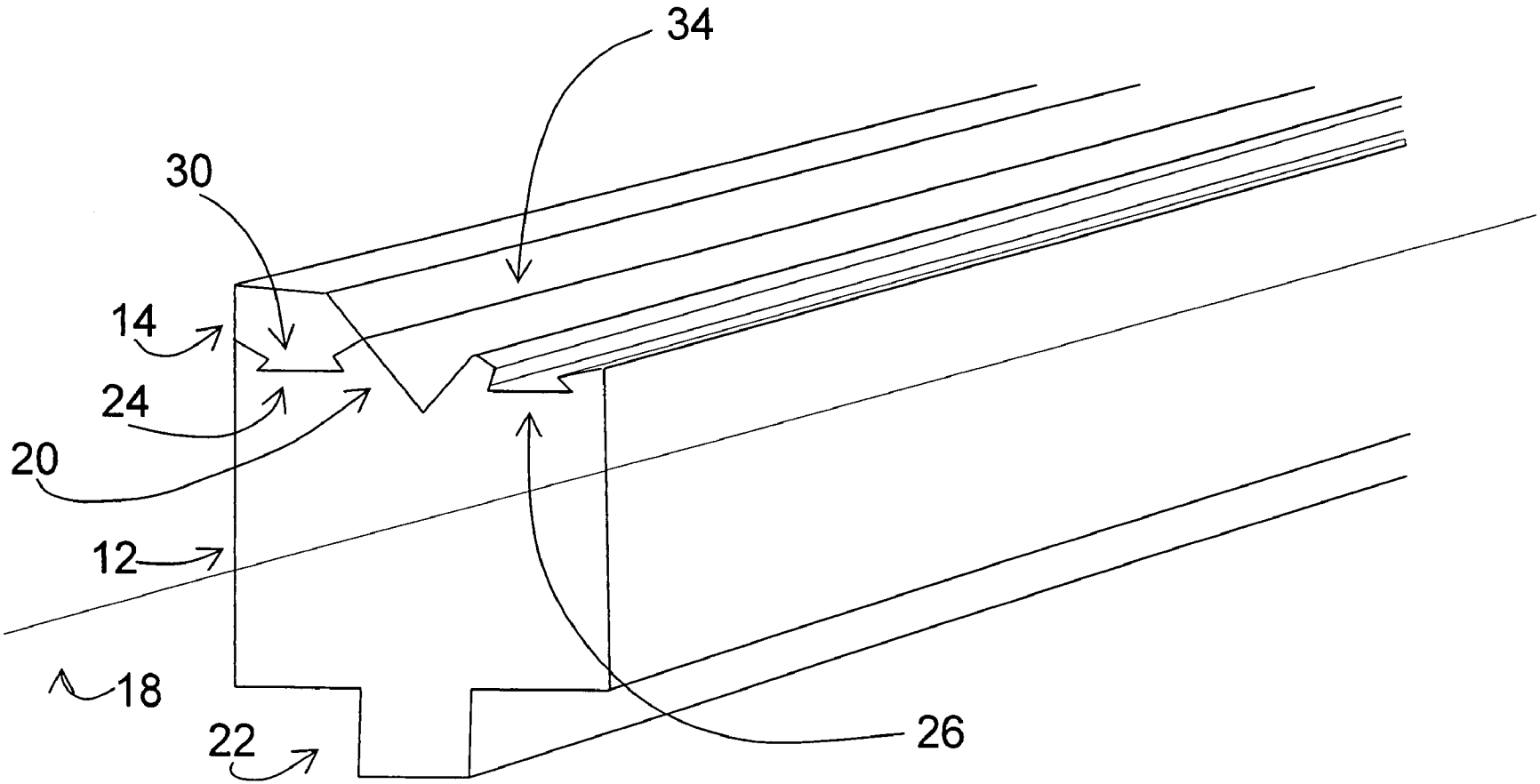
FIG. 2 shows a perspective view of the tool system of FIG. 1 with one insert removed.
Figure 3:
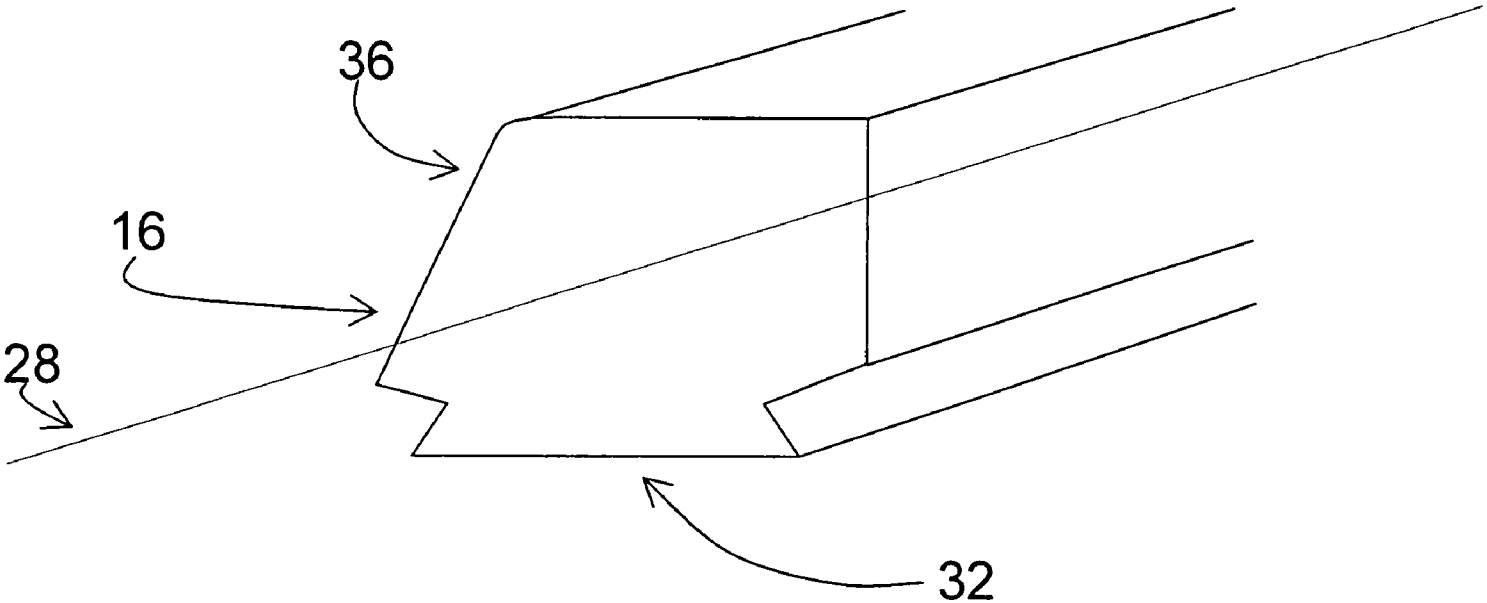
FIG. 3 shows a perspective view of one of the inserts of FIG. 1.

Referring now to FIG. 1, FIG. 2, and FIG. 3, there is shown one embodiment of the present invention comprising die 12 and inserts 14 and 16. Die 12 extends along longitudinal axis 18 and has defined shape 20 along longitudinal axis 18. Defined shape 20 is used as part of a bending surface for shaping a sheet of metal during brake forming. Generally, during operation, a sheet of metal is placed on top of die 12. A punch is pressed downward onto die 12 to substantially conform the sheet of metal to the shape of defined shape 20. In the embodiment shown in FIG. 1 and FIG. 2, defined shape 20 is substantially v-shaped, which will produce a metal piece having a substantial v-shape. However, the defined shape of a die of the present invention need not be substantially v-shaped. Other shapes are contemplated to be within the scope of the invention, including but not limited to a substantial u-shape (see FIG. 8), a substantial channel-shape (see FIG. 5), a substantial hat-channel shape (see FIG. 9), a substantial closing-shape, a substantial single form-shape, a substantial double form-shape, a substantial radius-shape, a substantial wipe die-shape, a substantial offset-shape (see FIG. 4), and a substantial flat-shape.

Persons of skill in the art will appreciate that die 12 may optionally include means 22 for attaching the die to a press brake system. Such attachments are well known in the art, and any method of attachment may be used and is contemplated to be within the scope of the invention.

Die 12 also comprises cavities 24 and 26 running along longitudinal axis 18. Each of cavities 24 and 26 has a certain cross-sectional shape with respect to longitudinal axis 28 (see FIG. 3) of insert 14 and insert 16, respectively. In the embodiment of FIG. 1 and FIG. 2, cavity 24 and cavity 26 have the same cross-sectional shape, namely a dove-tailed cross-sectional shape. However, as is explained in greater detail herein, the present invention includes dies having one or more cavities, with each of the cavities having the same or a different cross-sectional shape.

As previously mentioned, each of inserts 14 and 16 has longitudinal axis 28. Longitudinal axis 28 corresponds to (is in the same direction as) longitudinal axis 18 of die 12. Insert 14 comprises protrusion 30 for insertion into cavity 24; protrusion 30 has a cross-sectional shape that matches the cross-sectional shape of cavity 24. Likewise, insert 16 comprises protrusion 32 for insertion into cavity 26; protrusion 32 has a cross-sectional shape that matches the cross-sectional shape of cavity 26.

Cavity 24 and protrusion 30, as well as cavity 26 and protrusion 32, could have any one of many suitable cross-sectional shapes that are well known in the art, so long as the cross-sectional shape permits a removably fixed mechanical interlock between cavity 24 and protrusion 30 or between cavity 26 and protrusion 32, respectively, when the insert is inserted into the die according to the present invention. The removably fixed mechanical interlock between cavity 24 and protrusion 30 removably attaches insert 14 and die 12; the removably fixed mechanical interlock between cavity 26 and protrusion 30 removably attaches insert 16 and die 12. Therefore, by sliding protrusion 30 of insert 14 into cavity 24 of die 12, insert 14 is removably attached to die 12. Similarly, by sliding protrusion 32 of insert 16 into cavity 26 of die 12, insert 16 is removably attached to die 12. After insertion, each of insert 14 and insert 16 is fixed onto die 12, permitting little or no movement of the insert with respect to the die. It will be appreciated by persons of skill in the art that the present invention includes alternative embodiments in which the positioning of the protrusions and the cavities are reversed. In these embodiments, at least one protrusion is positioned on the die and a cavity is positioned on each insert. The cross-sectional shape of each protrusion of the die matches the cross-sectional shape of a cavity of each insert such that, when the inserts are removably attached to the die as described herein, there is little or no movement of the insert with respect to the die.

Insert 14 further comprises surface 34, which corresponds to a portion of defined shape 20 of die 12. As shown more particularly in FIG. 1 and FIG. 3, insert 16 further comprises surface 36, which corresponds to a portion of defined shape 20 of die 12. As such, surface 34 of insert 14, surface 36 of insert 16, and defined shape 20 of die 12 combine to form the bending surface against which the sheet of metal is pressed by a punch during operation.

Persons of skill in the art will appreciate that die 12 and inserts 14 and 16 may be made of any material with suitable strength and hardness to withstand the press braking process. Preferably, die 12 and inserts 14 and 16 are made of the same material, preferably hardened steel. However, insert 14, insert 16, or both inserts 14 and 16, may be made of a material different than the material of which die 12 is made. Many methods and materials may be used to make die 12 and inserts 14 and 16. For example, die 12 and inserts 14 and 16 may be comprised of D2 tool steel, heat treated to at least about 50 Rockwell, preferably to between about 55 Rockwell and about 60 Rockwell, then polished and ground. Inserts 14 and 16 and die 12 may be coated with a hardening material such as T.D. coating. T.D. coating is also known as thermal diffusion coating, thermoreactive diffusion coating, or Toyota diffusion coating. Such coatings are well known in the art and further assist the die and inserts in resisting wear and corrosion.

Die 10 may be created as a new product or may be created by machining a worn die for receipt of inserts 14 and 16.

Insert 14, insert 16, or both inserts 14 and 16, may be the same length as die 12 or may be of a different length. Preferably, insert 14 is the same length as insert 16. Multiple inserts 14 or 16 may be aligned in an end-to-end fashion along longitudinal axis 18 to form a longer insert 14 or 16, respectively.

Figure 4:
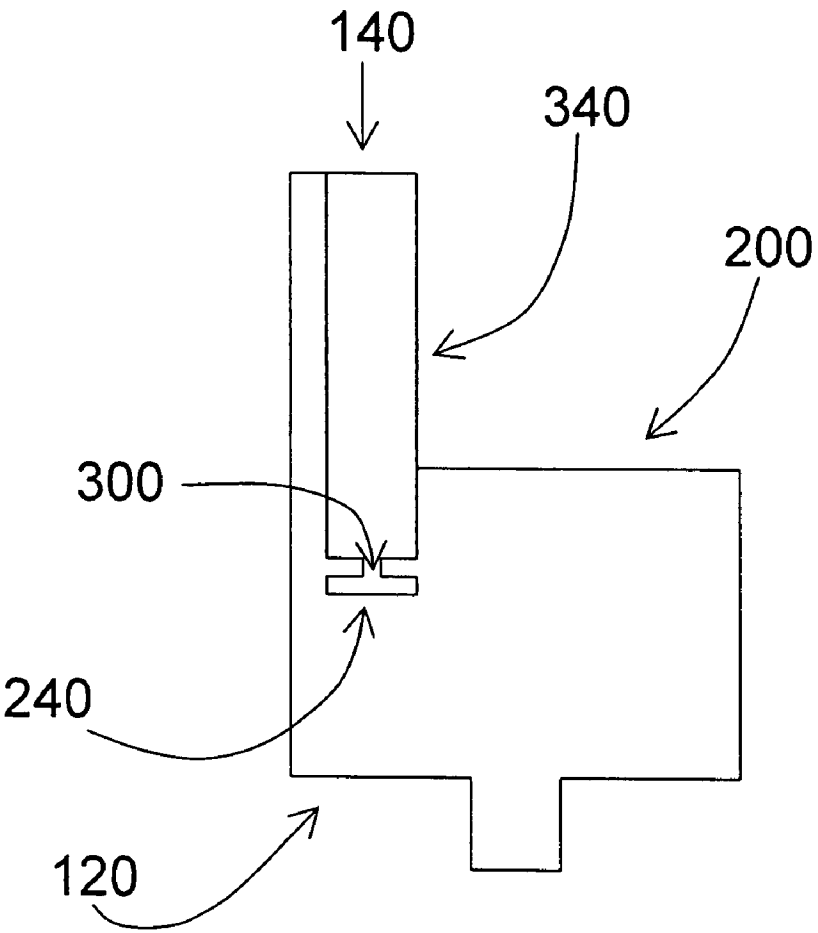
FIG. 4 shows a cross-sectional view of an embodiment of the present invention having a die and one insert.

Referring now to FIG. 4, there is shown another embodiment of the present invention which comprises die 120 and insert 140. Die 120 has defined shape 200, which is substantially offset-shaped. Die 120 further has cavity 240, which has the cross-sectional shape of an inverted-T. Insert 140 comprises protrusion 300, which has a cross-sectional shape that matches the inverted-T cross-sectional shape of cavity 240. Insert 140 further comprises surface 340, which corresponds to a portion of defined shape 200. As such, surface 340 of insert 140 and defined shape 200 combine to form the bending surface against which the sheet of metal is pressed by a punch during operation.

Figure 5:
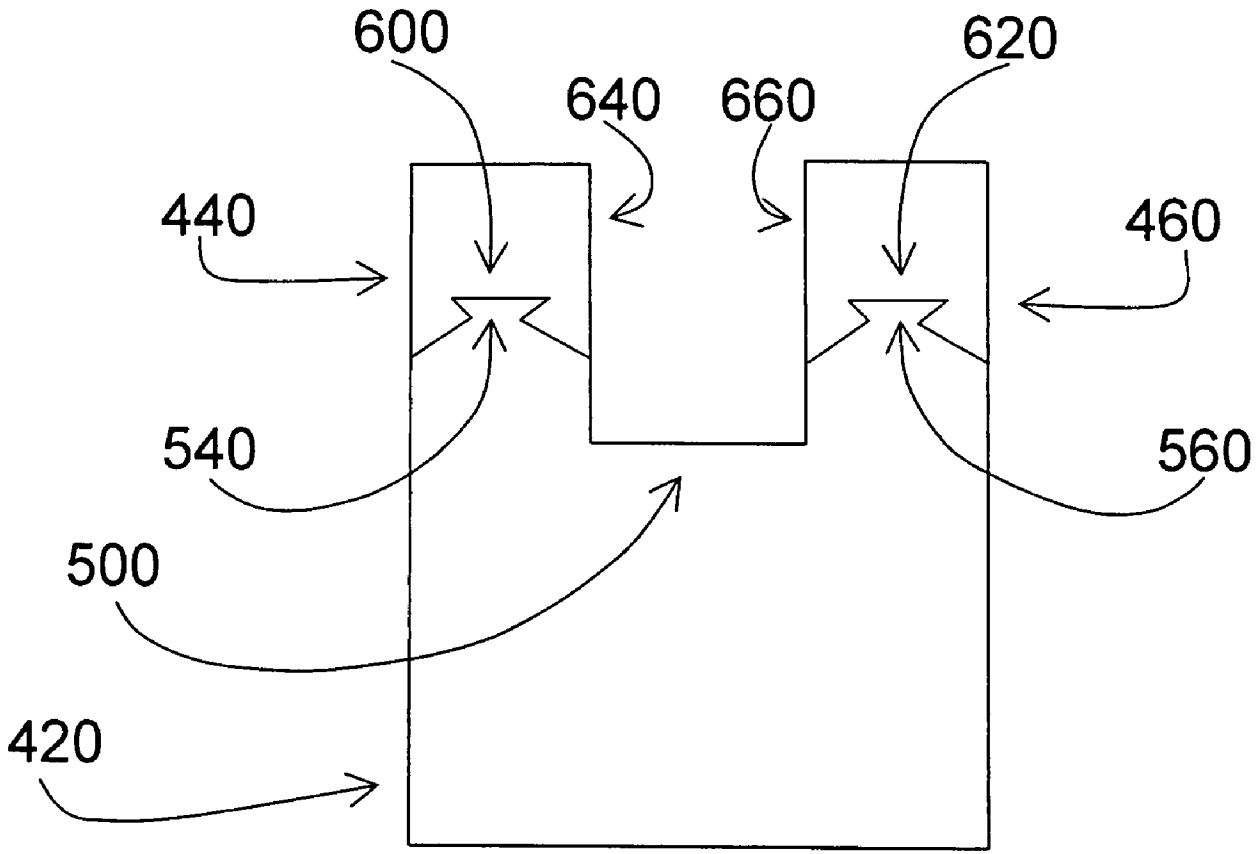
FIG. 5 shows a cross-sectional view of another embodiment of the present invention having a die and two inserts.

Referring now to FIG. 5, there is shown another embodiment of the present invention which comprises die 420 and inserts 440 and 460. Die 420 has defined shape 500, which is substantially channel-shaped. Die 420 further has protrusions 540 and 560, each of which has a cross-sectional shape, namely a dove-tailed cross-sectional shape. Insert 440 comprises cavity 600, which has a cross-sectional shape that matches the cross-sectional shape of protrusion 540. Similarly, insert 460 comprises cavity 620, which has a cross-sectional shape that matches the cross-sectional shape of protrusion 560. Insert 440 further comprises surface 640, which corresponds to a portion of defined shape 500 of die 420. Insert 460 further comprises surface 660, which corresponds to a portion of defined shape 500 of die 420. As such, surface 640 of insert 440, surface 660 of insert 460, and defined shape 500 of die 420 combine to form the bending surface against which the sheet of metal is pressed by a punch during operation.

Figure 6:
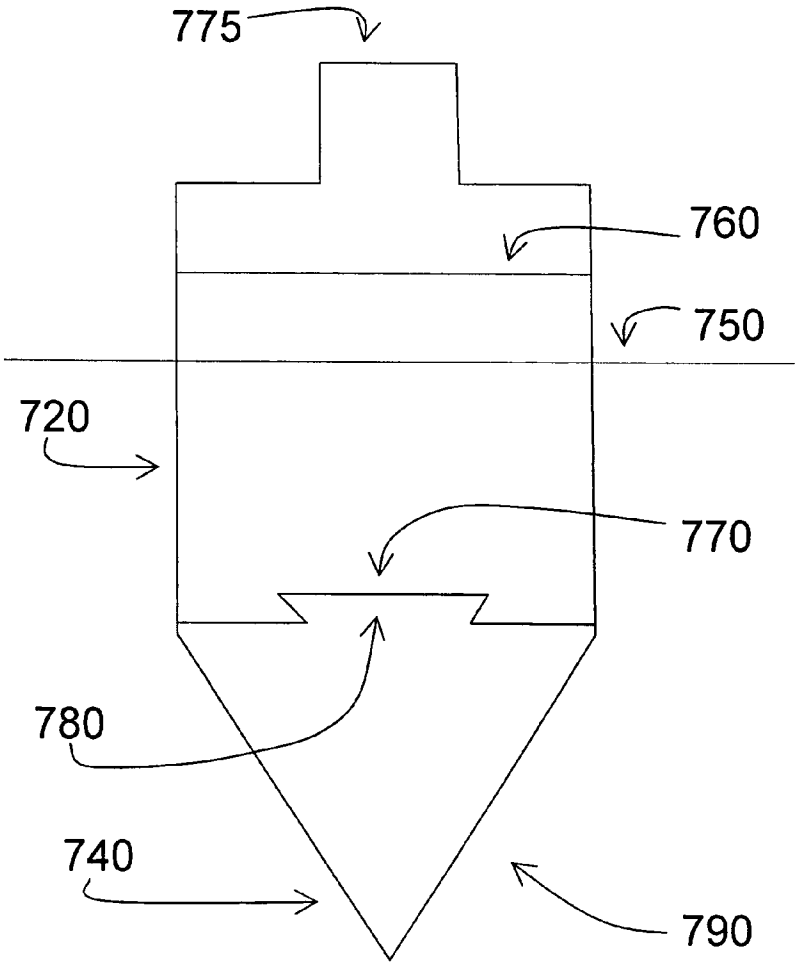
FIG. 6 shows a cross-sectional view of an embodiment of the present invention having a punch and an insert.

Referring now to FIG. 6, there is shown another embodiment of the present invention which comprises punch 720 and insert 740. Punch 720 has a longitudinal axis (not shown) and lateral axis 750. Punch 720 further has width 760 along lateral axis 750 and cavity 770 along its longitudinal axis. Cavity 770 has a cross-sectional shape, which, in the embodiment shown in FIG. 6, is a substantially dove-tailed cross-sectional shape.

Persons of skill in the art will appreciate that punch 720 may optionally include means 775 for attaching the punch to a press brake system. Such attachments are well known in the art, and any method of attachment may be used and is contemplated to be within the scope of the invention.

Insert 740 has a longitudinal axis (not shown) that corresponds to (is in the same direction as) the longitudinal axis of punch 720. Along its longitudinal axis, insert 740 has protrusion 780. Protrusion 780 has a cross-sectional shape that matches the cross-sectional shape of cavity 770 of punch 720. In the embodiment of FIG. 6, the cross-sectional shape of cavity 770 of punch 720 and of protrusion 780 of insert 740 is a substantially dove-tailed cross-sectional shape. However, those of skill in the art will appreciate that other suitable and well-known cross-sectional shapes, such as a substantially T-shaped cross-sectional shape or a substantially inverted-T cross-sectional shape, are contemplated to be within the scope of the invention, so long as the cross-sectional shape permits a removably fixed mechanical interlock between cavity 770 and protrusion 780 when the insert is inserted into the punch according to the present invention. The removably fixed interlock between cavity 770 and protrusion 780 removably attaches punch 720 and insert 740. Therefore, by sliding protrusion 780 of insert 740 into cavity 770 of punch 720, insert 740 is removably attached to punch 720. After insertion, insert 740 is fixed onto punch 720, permitting little or no movement of the insert with respect to the punch.

Insert 740 has surface 790 for shaping a sheet of metal. During operation of the press brake, a sheet of metal is placed upon a die. Punch 720 and attached insert 740 are pressed downward such that surface 790 of insert 740 contacts the sheet of metal, pressing the sheet of metal downward and forming the sheet of metal into a desired shape. Generally, the desired shape of the sheet of metal is substantially the shape of surface 790 of insert 740 or of the bending surface of the die. Often, the shape of surface 790 is substantially the same as the shape of the bending surface of the die. In the embodiment of FIG. 6, surface 790 is substantially v-shaped, although other shapes may be used. Other shapes contemplated to be within the scope of the invention include, but are not limited to, a substantial u-shape, a substantial channel-shape, a substantial hat-channel shape, a substantial offset-shape, and a substantial flat shape.

Surface 790 of insert 740 is at least about as wide along lateral axis 750 as width 760 of punch 720. This prevents punch 720 from contacting the sheet of metal during operation of the brake press.

Persons of skill in the art will appreciate that punch 720 and insert 740 may be made of any material with suitable strength and hardness to withstand the press braking process. Preferably, punch 720 and insert 740 are made of the same material, preferably hardened steel. However, insert 740 may be made of a material different than the material of which punch 720 is made. Many methods and materials may be used to make punch 720 and insert 740. For example, punch 720 and insert 740 may be comprised of D2 tool steel, heat treated to at least about 50 Rockwell, preferably to between about 55 Rockwell and about 60 Rockwell, then polished and ground. Punch 720 and insert 740 may be coated with a hardening material such as T.D. coating. Such coatings are well known in the art and further assist the punch and inserts in resisting wear and corrosion.

Punch 720 may be created as a new product or may be created by machining a worn punch for receipt of insert 740.

Insert 740 may be the same length as punch 720 or may be of a different length. Multiple inserts 740 may be aligned in an end-to-end fashion along the longitudinal axis of the punch to form a longer insert 740.

Figure 7:
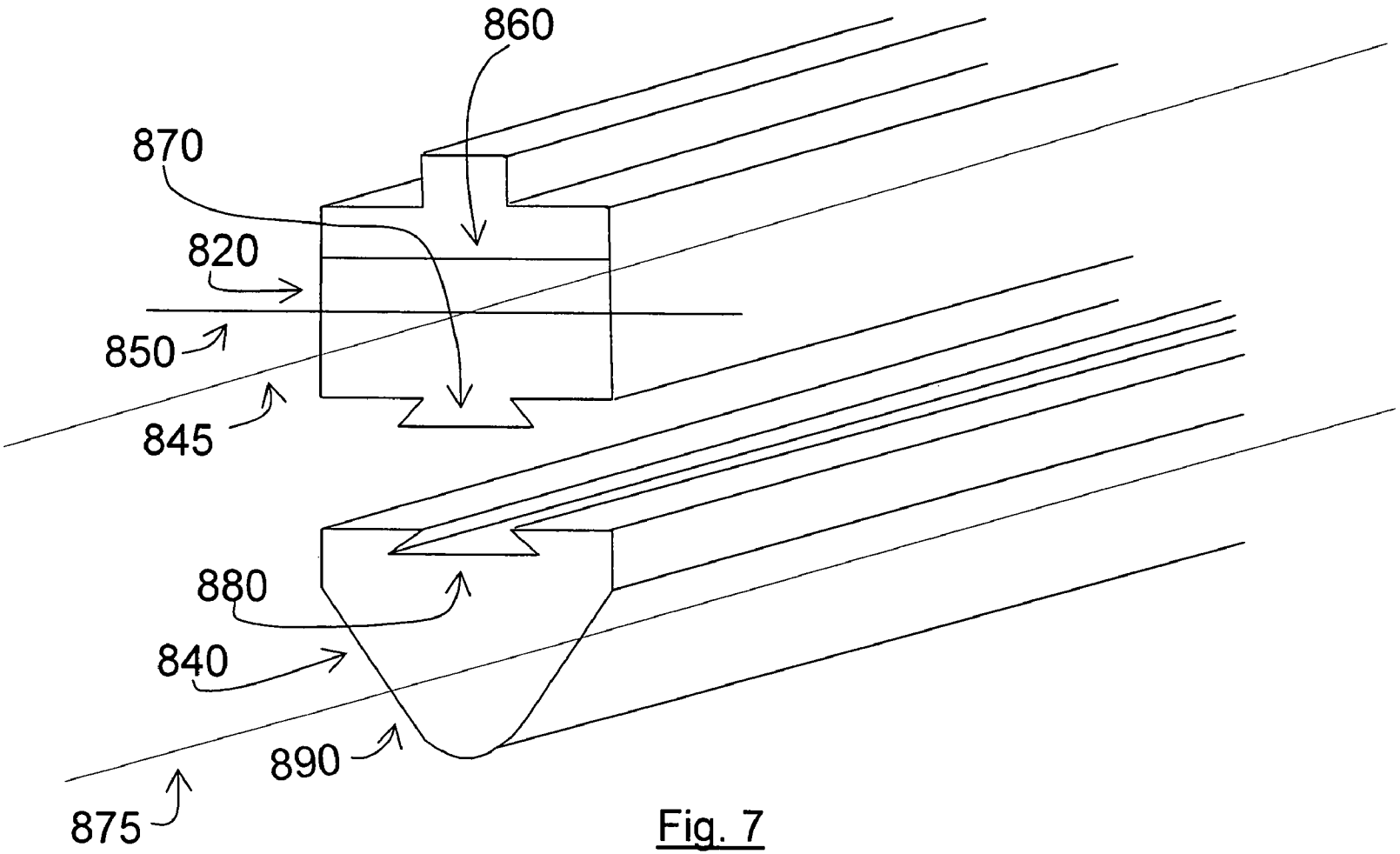
FIG. 7 shows a perspective view of another embodiment of the present invention having a punch and an insert, wherein the insert is shown detached from the punch.

It will be appreciated by those of skill in the art that the present invention includes alternative embodiments in which the positioning of the protrusion of the insert and the cavity of the punch is reversed. For example, referring now to FIG. 7, there is shown another embodiment of the present invention which comprises punch 820 and insert 840. Punch 820 has longitudinal axis 845 and lateral axis 850. Punch 820 further has width 860 along lateral axis 850 and protrusion 870 along longitudinal axis 845. Protrusion 870 has a cross-sectional shape, which, in the embodiment shown in FIG. 7, is a substantially dove-tailed cross-sectional shape.

Insert 840 has longitudinal axis 875 that corresponds to (is in the same direction as) longitudinal axis 845 of punch 820. Along longitudinal axis 875, insert 840 has cavity 880. Cavity 880 has a cross-sectional shape that matches the cross-sectional shape of protrusion 870 of punch 820. In the embodiment of FIG. 7, the cross-sectional shape of protrusion 870 of punch 820 and of cavity 880 of insert 840 is a substantially dove-tailed cross-sectional shape. However, those of skill in the art will appreciate that other suitable and well-known cross-sectional shapes are contemplated to be within the scope of the invention, so long as the cross-sectional shape permits a removably fixed mechanical interlock between protrusion 870 and cavity 880 when the insert is inserted into the punch according to the present invention. The removably fixed interlock between protrusion 870 and cavity 880 removably attaches punch 820 and insert 840. Therefore, by sliding cavity 880 of insert 840 onto protrusion 870 of punch 820, insert 840 is removably attached to punch 820. After insertion, insert 840 is fixed onto punch 820, permitting little or no movement of the insert with respect to the punch.

Insert 840 has surface 890 for shaping a sheet of metal. During operation of the press brake, a sheet of metal is placed upon a die. Punch 820 and attached insert 840 are pressed downward such that surface 890 of insert 840 contacts the sheet of metal, pressing the sheet of metal downward and forming the sheet of metal into a desired shape. Generally, the desired shape of the sheet of metal is substantially the shape of surface 890 of insert 840 or of the bending surface of the die. Often, the shape of surface 890 is substantially the same as the shape of the bending surface of the die. In the embodiment of FIG. 7, surface 890 is substantially u-shaped. However, other suitable shapes are within the scope of the invention, as discussed herein with respect to other embodiments.

Surface 890 of insert 840 is at least about as wide along lateral axis 850 as width 860 of punch 820. This prevents punch 820 from contacting the sheet of metal during operation of the brake press.

Figure 8:
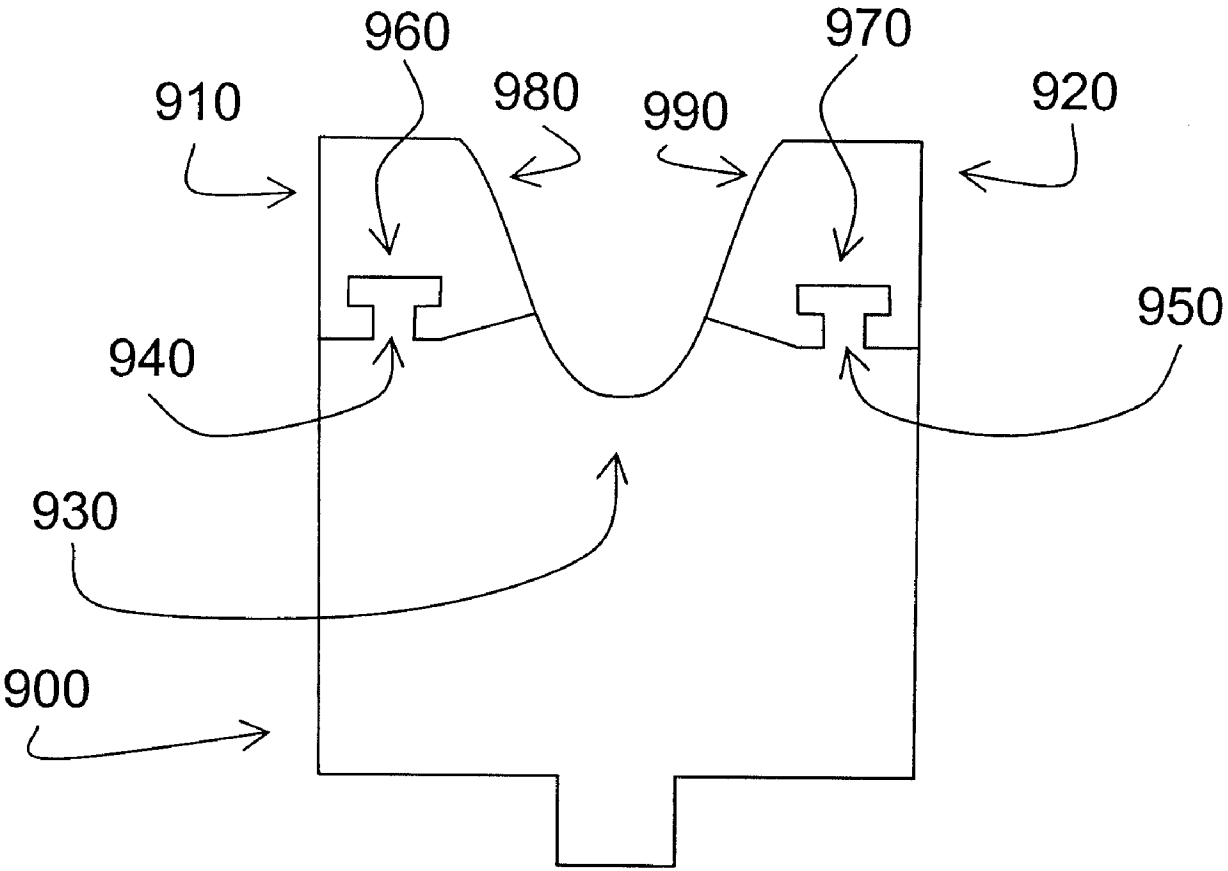
FIG. 8 shows a cross-sectional view of another embodiment of the present invention having a die and inserts.

Referring now to FIG. 8, there is shown an embodiment comprising a die 900 and two inserts 910 and 920. Die 900 has a defined shape 930, which is substantially u-shaped. Die 900 further has protrusions 940 and 950, each of which has a cross-sectional shape, namely a substantially T-shaped cross-sectional shape. Insert 910 comprises cavity 960, which has a cross-sectional shape that matches the cross-sectional shape of protrusion 940. Insert 920 comprises cavity 970, which has a cross-sectional shape that matches the cross-sectional shape of protrusion 950. Insert 910 further comprises surface 980, which corresponds to a portion of defined shape 930 of die 900. Insert 920 further comprises surface 990, which corresponds to a portion of defined shape 930 of die 900. As such, surface 980 of insert 910, surface 990 of insert 920, and defined shape 930 of die 900 combine to form the bending surface against which the sheet of metal is pressed by a punch during operation.

Figure 9:
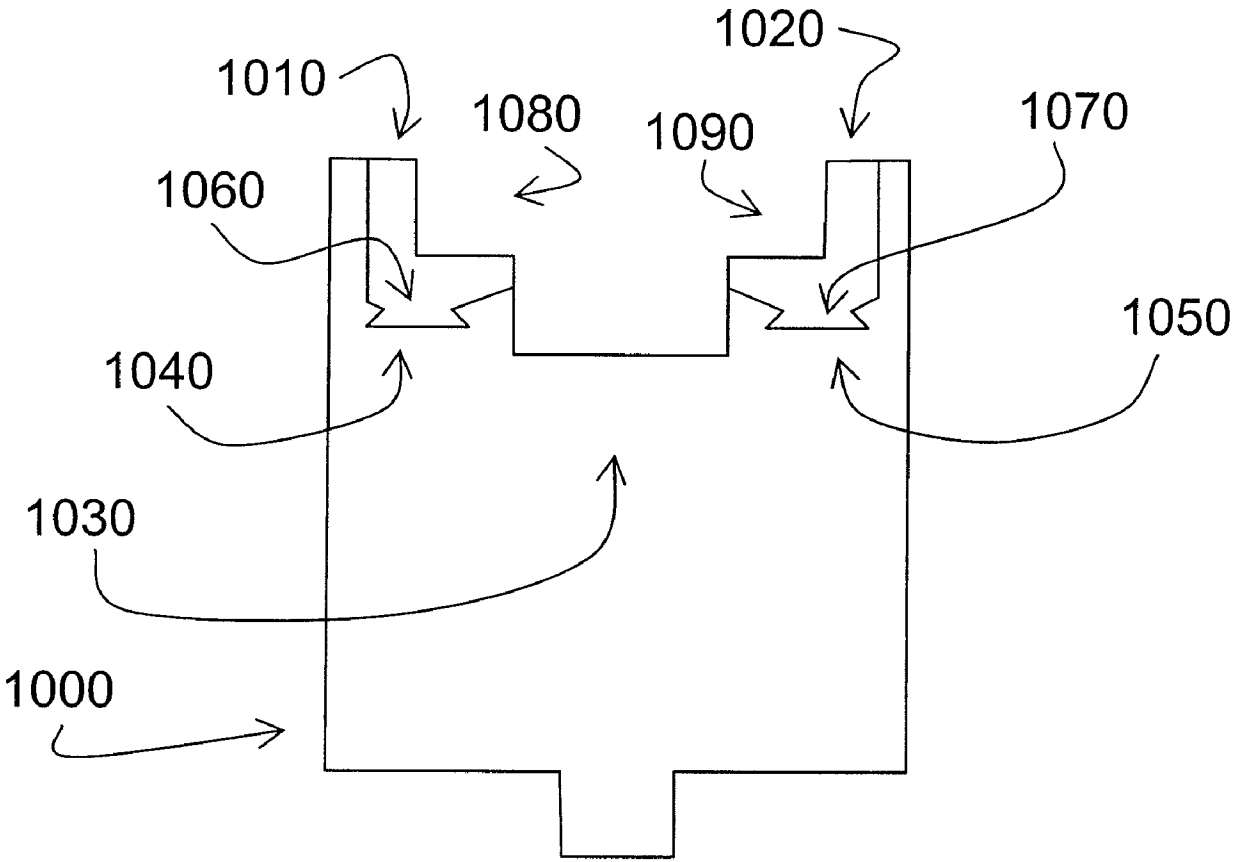
FIG. 9 shows a cross-sectional view of another embodiment of the present invention having a die and inserts.

Referring now to FIG. 9, there is shown an embodiment comprising a die 1000 and two inserts 1010 and 1020. Die 1000 has a defined shape 1030, which is substantially hat-channel shaped. Die 1000 further has cavities 1040 and 1050, each of which has a cross-sectional shape, namely a substantially dove-tailed cross-sectional shape. Insert 1010 comprises protrusion 1060, which has a cross-sectional shape that matches the cross-sectional shape of cavity 1040. Insert 1020 comprises protrusion 1070, which has a cross-sectional shape that matches the cross- sectional shape of cavity 1050. Insert 1010 further comprises surface 1080, which corresponds to a portion of defined shape 1030 of die 1000. Insert 1020 further comprises surface 1090, which corresponds to a portion of defined shape 1030 of die 1000. As such, surface 1080 of insert 1010, surface 1090 of insert 1020, and defined shape 1030 of die 1000 combine to form the bending surface against which the sheet of metal is pressed by a punch during operation.

It will be appreciated by those of skill in the art that the present invention provides tool systems for a press brake that are resistant to wear and that significantly reduce the costs of the press brake process. The inserts of the tool system are positioned on the punch or the die such that the inserts undergo the majority of the wear associated with the press brake process. Consequently, the punch and the die undergo very little wear during use. As a result, the useful life of the punch is dramatically increased, as is the useful life of the die. Because the inserts are much less expensive to make and replace than to make and replace conventional punches or dies, replacing only the inserts produces significant cost savings over a conventional tool system in which the entire punch or the entire die must be replaced every certain number of uses.

The present invention can be further modified within the scope and spirit of this disclosure. It will be understood by those of skill in the art that the preferred embodiments disclosed herein describe the present invention in detail, but do not limit or restrict the scope of the invention. The disclosure is intended to cover any variations, uses, or adaptations of the invention using its general principles. Further, this disclosure is intended to cover such departures from the disclosed embodiments as come within known or customary practice in the art to which this invention pertains and which fall within the limits of the appended claims.

I claim:

1. An apparatus, comprising:

a die having a longitudinal axis, the die having a defined shape along the longitudinal axis and at least one cavity along the longitudinal axis, wherein the defined shape is used for shaping a sheet of metal and wherein the at least one cavity has a cross-sectional shape; and at least one insert having a longitudinal axis that corresponds to the longitudinal axis of the die, the at least one insert having a protrusion along the longitudinal axis of the insert and at least one surface for shaping the sheet of metal, wherein the protrusion has a cross-sectional shape that matches the cross-sectional shape of the at least one cavity and wherein the at least one surface for shaping the sheet of metal corresponds to at least a portion of the defined shape of the die;

such that the protrusion of the at least one insert may be inserted into one of the at least one cavity of the die to result in a removably fixed mechanical interlock between the at least one cavity and the protrusion.

2. The apparatus of claim 1, wherein:

the at least one insert and the die are made of the same material.

3. The apparatus of claim 1, wherein:

the at least one insert is made of steel.

4. The apparatus of claim 3, wherein:

the at least one insert is heat treated to at least about 50 Rockwell.

5. The apparatus of claim 4, wherein:

the at least one insert is heat treated to between about 55 Rockwell and about 60 Rockwell.

6. The apparatus of claim 3, wherein:

the at least one insert is coated with a thermal diffusion coating.

7. The apparatus of claim 3, wherein:

the defined shape of the die is substantially v-shaped.

8. The apparatus of claim 3, wherein:

the defined shape of the die is substantially channel-shaped.

9. The apparatus of claim 3, wherein:

the defined shape of the die is substantially offset-shaped.

10. The apparatus of claim 3, wherein:

the defined shape of the die is substantially flat.

11. The apparatus of claim 3, wherein:

the at least one cavity of the die has a substantially dove-tailed cross-sectional shape.

12. The apparatus of claim 3, wherein:

the at least one cavity of the die has a substantially inverted-T cross-sectional shape.

13. An apparatus, comprising:

a die having a longitudinal axis, the die having a defined shape along the longitudinal axis and at least one protrusion along the longitudinal axis, wherein the defined shape is used for shaping a sheet of metal and wherein the at least one protrusion has a cross-sectional shape; and at least one insert having a longitudinal axis that corresponds to the longitudinal axis of the die, the at least one insert having a cavity along the longitudinal axis of the insert and at least one surface for shaping the sheet of metal, wherein the cavity has a cross-sectional shape that matches the cross-sectional shape of the at least one protrusion and wherein the at least one surface for shaping the sheet of metal corresponds to at least a portion of the defined shape of the die;

such that the at least one protrusion of the die may be inserted into the cavity of the at least one insert to result in a removably fixed mechanical interlock between the at least one protrusion and the cavity.

14. The apparatus of claim 13, wherein:

the at least one insert and the die are made of the same material.

15. The apparatus of claim 13, wherein:

the at least one insert is made of steel.

16. The apparatus of claim 15, wherein:

the at least one insert is heat treated to at least about 50 Rockwell.

17. The apparatus of claim 16, wherein:

the at least one insert is heat treated to between about 55 Rockwell and about 60 Rockwell.

18. The apparatus of claim 15, wherein:

the at least one insert is coated with a thermal diffusion coating.

19. The apparatus of claim 15, wherein:

the defined shape of the die is substantially v-shaped.

20. The apparatus of claim 15, wherein:

the defined shape of the die is substantially channel-shaped.

21. The apparatus of claim 15, wherein:

the defined shape of the die is substantially offset-shaped.

22. The apparatus of claim 15, wherein:

the defined shape of the die is substantially flat.

23. The apparatus of claim 15, wherein:

the at least one protrusion of the die has a substantially dove-tailed cross-sectional shape.

24. The apparatus of claim 15, wherein:

the at least one protrusion of the die has a substantially T-shaped cross-sectional shape.

* * * * *